US007938731B2

(12) United States Patent
Papageorge et al.

(10) Patent No.: US 7,938,731 B2
(45) Date of Patent: May 10, 2011

(54) COMPARTMENT FOR INTEGRATING AN ELECTRONIC DEVICE IN A CHILD MOTION DEVICE

(75) Inventors: Nick Efthemios Papageorge, Upper Darby, PA (US); William B. Bellows, Wyomssing, PA (US); Joshua E. Clapper, Exeter, PA (US)

(73) Assignee: Graco Children's Products Inc., Exton, PA (US)

( * ) Notice: Subject to any disclaimer, the term of this patent is extended or adjusted under 35 U.S.C. 154(b) by 702 days.

(21) Appl. No.: 11/932,353

(22) Filed: Oct. 31, 2007

(65) Prior Publication Data

US 2008/0136229 A1 Jun. 12, 2008

Related U.S. Application Data

(60) Provisional application No. 60/855,894, filed on Oct. 31, 2006, provisional application No. 60/908,176, filed on Mar. 26, 2007.

(51) Int. Cl.
*A63G 1/28* (2006.01)
*A63G 1/00* (2006.01)

(52) U.S. Cl. ..... 472/29; 472/119; 297/250.1; 446/227

(58) Field of Classification Search ..... 472/29–32, 472/118–125; 297/250.1, 411.2, 411.38; 280/642, 647, 658, 47.38
See application file for complete search history.

(56) References Cited

U.S. PATENT DOCUMENTS

| | | | | |
|---|---|---|---|---|
| 5,409,246 | A | 4/1995 | Ali | |
| 6,908,151 | B2 * | 6/2005 | Meeker et al. | 297/250.1 |
| 6,932,377 | B2 * | 8/2005 | Bretschger et al. | 280/642 |
| 7,077,405 | B2 * | 7/2006 | Akpom | 280/47.38 |
| 7,195,314 | B2 * | 3/2007 | Spence et al. | 297/250.1 |
| 2004/0140699 | A1 | 7/2004 | Akpom | |
| 2004/0212163 | A1 | 10/2004 | Bretschger et al. | |
| 2006/0208543 | A1 | 9/2006 | Spence et al. | |
| 2007/0111809 | A1 | 5/2007 | Bellows et al. | |

FOREIGN PATENT DOCUMENTS

GB 2 418 647 4/2006

OTHER PUBLICATIONS

Baby Einstein Discovering Water Rocker Seat Model #30744, www.kidsii.com, 3 pages (Sep. 13, 2007; copyright date 2001-2007).

Britax Instruction Manual, Platinum AHR Rowsgate #3446, Convertible Car Seat Child Restraint with AHR Headrest, www.britax.com.au, pp. 1, 2, 31 and 36 (2004-2005).

Kolcraft Jeep Overland Limited Jogging Stroller Model #JJ001, www.kolcraft.com, 4 pages (Sep. 13, 2007).

International Search Report and Written Opinion issued in corresponding International application No. PCT/US2007/083225 issued Jun. 3, 2008.

* cited by examiner

*Primary Examiner* — Kien T Nguyen
(74) *Attorney, Agent, or Firm* — Lempia Summerfield Katz LLC

(57) ABSTRACT

A child motion device has a frame assembly and a seat supported by the frame assembly and capable of movement with a child occupying the seat. A housing is provided on a part of the frame assembly. A receptacle is provided in the housing and is positioned spaced from and faces away from the seat. A storage tray is located in the compartment and defines a storage space on the tray. The tray is movable between an opened position with the storage space and the tray extending outside the housing away from the seat and a closed position with the tray and storage space within the receptacle in the housing.

19 Claims, 8 Drawing Sheets

COMPARTMENT FOR INTEGRATING AN ELECTRONIC DEVICE IN A CHILD MOTION DEVICE

CROSS-REFERENCES TO RELATED APPLICATIONS

This application claims the benefit of U.S. provisional application Ser. No. 60/855,894, entitled "Motion Control Devices and Methods," and filed Oct. 31, 2006 and Ser. No. 60/908,176, entitled "Child Device Storage Compartment for Integration of a Music Player," and filed Mar. 26, 2007, the entire disclosures of which are hereby expressly incorporated by reference.

BACKGROUND OF THE DISCLOSURE

1. Field of the Disclosure

The present disclosure is generally directed to child motion devices, and more particularly to a child motion device with a sliding storage compartment for integrating a music player or other electronic device with the child motion device.

2. Brief Description of Related Technology

There are a number of commonly known juvenile products that are equipped and configured to seat a child, such as strollers, infant carriers, car seats, playards, bouncer seats, entertainers, and swings. Some juvenile products are known to be provided with continuous motion capabilities created by an electronic motor or with on-board electronics for entertainment or soothing purposes. For example, a conventional child swing typically includes an A-frame type support structure, hanger arms pivotally attached to the frame, and a seat suspended on the hanger arms. An electrically powered drive mechanism is often utilized to supply energy to swing the seat in a continuous pendulum swinging motion.

A number of child swings and other juvenile products are also known to include electrically powered features that can sooth the child. For example, some swings employ a mechanism to vibrate the seat, wherein the vibration is generated from an electric power source in order to calm the baby. A number of swings and other juvenile products have also implemented speaker systems that emit sounds that are intended to sooth the child. In one example, the speakers can emit music or other soothing sounds provided by an on-board memory device.

Additionally, some juvenile products are known that provide designated, open compartments that are configured to store a number of items ranging from handheld digital music players to water bottles. These types of known compartments often include exposed input/output headphone jacks on an exterior of the device adjacent the open compartment. The jacks are wired to an internal or on-board speaker system and thus intended to emit music from the personal or handheld music player for both the child and the caregiver. The wires between the jacks and the handheld unit are typically exposed and thus can be inadvertently grabbed, caught, unplugged, damaged, or the like during normal use. Further, the child seat occupant may accidentally become entangled in the wires as well. These disadvantages can be magnified if the juvenile product is a child motion device such as a swing.

Several commercially available juvenile products have been adapted to accommodate handheld digital music players. For example, the Discovering Water Rocker Seat, which is available from Baby Einstein as model number 30744, and the Platinum AHR Rowsgate, which is available from Britax (Australia) as model number 3446, both include on-board speaker systems and an accompanying external headphone jack. As another example, the Overland Limited Jogging Stroller, which is available from Jeep as model number JJ001, also incorporates an on-board speaker system. This stroller product places the audio wire headphone jack within a cavity on the stroller that is covered by a lid. The wires, however, between the handheld music player and the jacks are still typically lengthy and can extend from the cavity and the lid can be accessible to an occupant of the stroller.

Unfortunately, these known compartment and jack configurations are often easily within reach of the child seat occupant. Thus, the wires are also within reach of the child. Further, the wires utilized for these products are typically provided by the caregiver to substitute the headphone wires for the music players. Thus, the caregiver must obtain the wires in order to take advantage of the feature. These wires also are typically relatively lengthy and thus can be easily grabbed by a child or be accidentally tangled or caught on other objects during use of the juvenile product. This could become an even stronger disadvantage in child motion devices such as swings, and particularly where the child seat moves relative to the compartment and/or the wires.

BRIEF DESCRIPTION OF THE DRAWING FIGURES

Objects, features, and advantages of the present disclosure will become apparent upon reading the following description in conjunction with the drawing figures, in which like reference numerals identify like elements in the figures, and in which.

Figure 1:
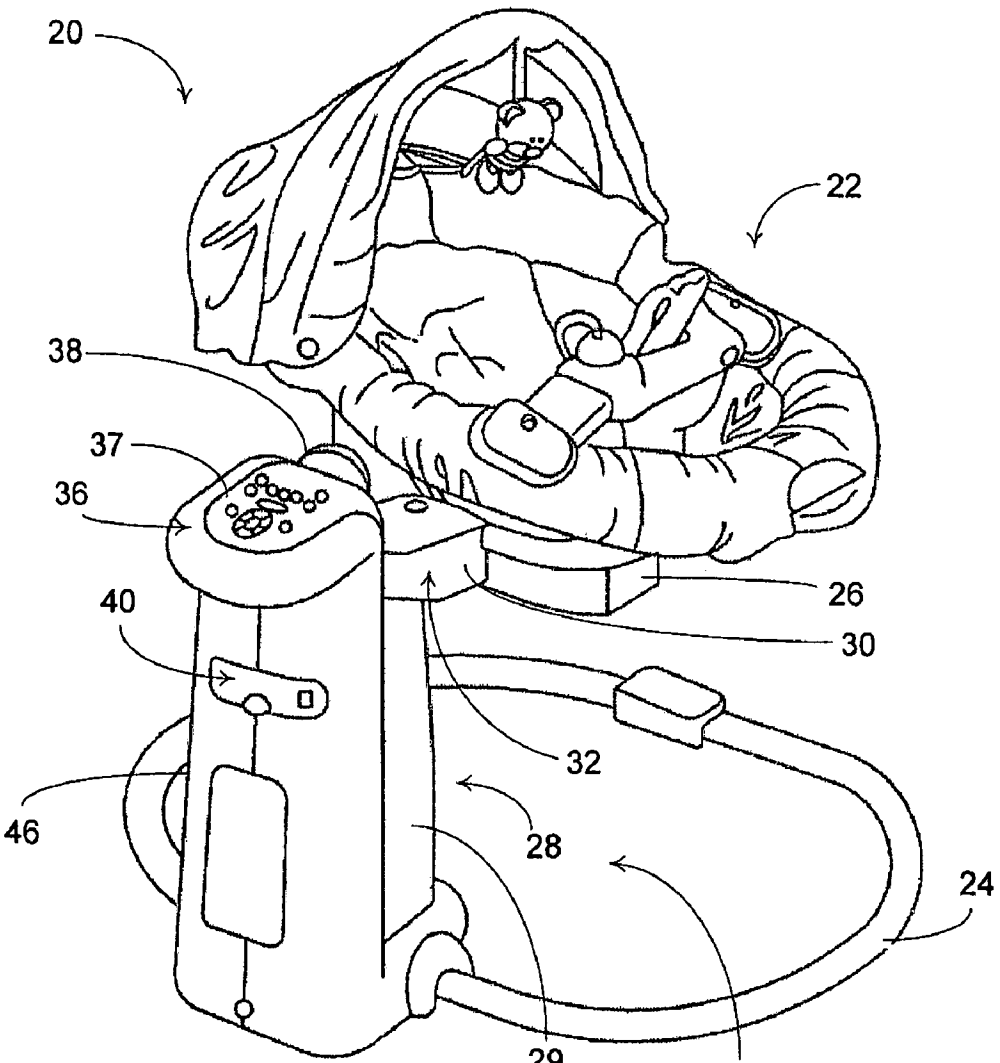
FIG. 1 is a perspective view of one example of a child motion device in the form of an orbit motion swing and having a storage compartment constructed in accordance with the teachings of the present invention.

While the disclosed storage compartments and juvenile product are susceptible of embodiments in various forms, specific embodiments of the invention are illustrated in the drawings and are described hereafter with the understanding that the disclosure is intended to be illustrative, and is not intended to limit the invention to the specific embodiments described and illustrated herein.

DETAILED DESCRIPTION OF THE DISCLOSURE

A storage compartment is disclosed herein for use with juvenile products, and particularly for child motion devices.

The disclosed compartment examples solve or improve upon one or more of the above known and other problems and disadvantages with prior known products, compartments, and methods. In one example, a child motion device is disclosed that employs a storage compartment that can be slid between a closed position and an open position. In another example, a storage compartment is disclosed that has been configured to limit or inhibit accessibility to items stored in the compartment. In a further example, a storage compartment is disclosed that is employed in an orbit motion swing device. In still another example, a storage compartment is disclosed that hides the entire device and all associate wires within the storage compartment when closed. In yet another example, a storage compartment is disclosed as having a catch that creates resistance to tray or drawer movement from the closed to the open position and that positively notifies a user when the drawer or tray is fully closed. In yet another example, a storage compartment is disclosed that provides all of the necessary electrical cords, wires, or cables that connect an electronic device stored in the compartment and that is capable of managing these wires and cables.

Although the storage compartment described below is used in conjunction with an orbit motion child swing, the disclosed compartment can also be employed on other juvenile products such as strollers, car seats, and the like. For example, the disclosed storage compartment can be applied to any juvenile product that has an electronic aspect and a housing structure with a height, width, and depth sufficient to accommodate such a storage compartment. The disclosed compartment particularly well suited for juvenile products that either create or permit child motion and that have an on-board speaker system. The disclosed storage compartment completely houses an electronic device and its cords, closes with a positive latch feature, and provides accord management feature as well.

Figure 2:
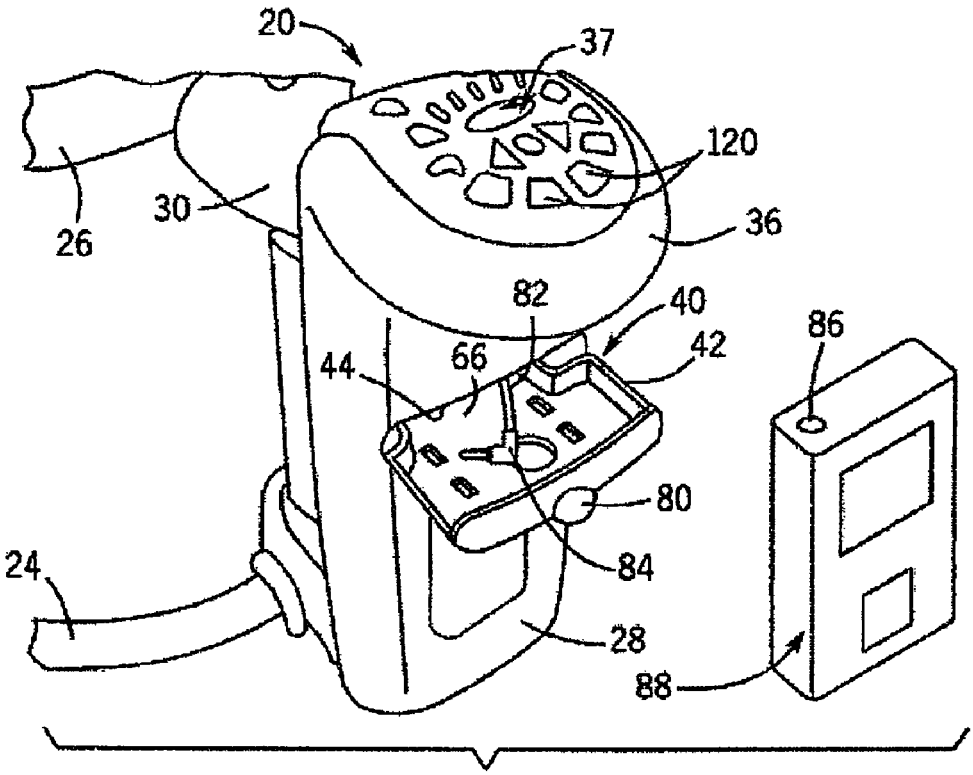
FIGS. 2 and 3 are perspective views of the child motion device of FIG. 1 and showing the storage compartment in an opened and a closed position, respectively.
Figure 3:
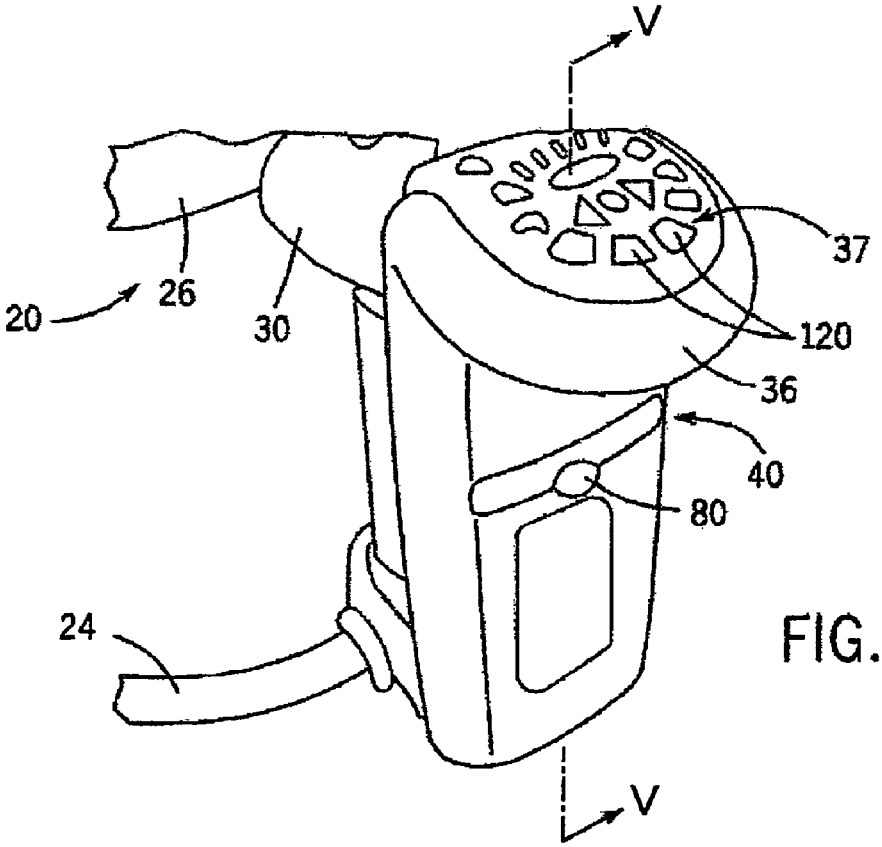

Referring now to the drawings, FIGS. 1-3 illustrate one example of a juvenile product constructed in accordance with the teachings of the present invention. In this example, the juvenile product is a child motion device 20 incorporating various aspects of the disclosure. The device 20 in this example generally includes a frame assembly 21 configured to support an occupant seat 22 above a surface on which the device 20 rests. A base section 24 of the frame assembly 21 rests on the surface to provide a stable base for the device 20 while in-use. The frame assembly 21 also includes a seat support frame 26 on which the seat 22 is mounted. The seat frame 26 is generally suspended over the base section 24 and is configured and arranged to impart reciprocating orbital-type movement of the seat 22 during operation.

To that end, an upright post 28 of the frame assembly 21 extends upward from the base section 24 and acts as a riser or spine for the device. A support arm 30 extends radially outward from the post 28 and is connected to and supports the seat frame 26. In this example, the post or spine 28 is oriented in a generally vertical orientation relative to its longitudinal length. The post 28 has an external housing 29 that may be configured in any desired or suitable manner to provide a pleasing or desired aesthetic appearance. The housing 29 can also be functional or can serve both a functional and ornamental purpose. For instance, the housing 29 can act as a protective cover for the internal components, such as the drive system (not shown) of the device 20. Some or all of the housing 29 may constitute a removable cover for access to the interior or inner workings of the device 20, if needed. In any case, the housing 29 and, more generally, the post 28, may vary considerably in orientation, shape, size, configuration, and the like from the examples disclosed herein.

As best shown in FIGS. 1-3, a driven end 32 of the support arm 30 is coupled to a structural support, or weight bearing, portion 34 of the post 28. In this example, the support arm 30 is cantilevered from the post 28 at the driven end 32. The support arm 30 is mounted for pivotal, side-to-side movement about its driven end 32 through a travel path that is substantially horizontal. Further details regarding the travel path, as well as other exemplary travel paths, can be found in U.S. Patent Publication No. 2007/0111809, entitled "Child Motion Device," the entire disclosure of which is hereby incorporated by reference. As described therein, the support arm 30 can travel or reciprocate through a partial orbit or arc segment of a predetermined angle and can rotate about an axis of rotation that can be offset from a vertical reference and that can be offset from an axis of the post 28. Alternatively, the axis of rotation can be aligned with the vertical reference, the axis of the post 28, or both, if desired. More generally, the driven end 32 is coupled to a drive system (not shown) that is disposed within the housing 29 and configured to reciprocate or oscillate a distal end of the support arm 30 to which the seat frame 26 is attached. This results in corresponding movement of the occupant seat 22 through the partial orbit.

The device 20 includes a number of components directed to controlling and/or facilitating the motion and other functionality of the device 20. In the example shown, several of these control components are disposed on or in a control portion 36 of the post 28. In some cases, the control portion 36 may also contain portions of the drive system or structural support elements of the device 20. In this example, the control portion 36 has an upper panel 37 to present an instrumentation or control interface to a caregiver for directing the operation of the device 20. The positioning and configuration of the instrumentation and other interface elements may vary considerably from that shown. For instance, the instrumentation need not be arranged in a single panel, but rather may be distributed over multiple locations on the control portion 36 or on one or more other parts of the housing 29 or other component of the device 20.

In the example shown in FIGS. 1-3, the base section 24 of the frame assembly 21 is in the form of an oval hoop or ring sized to provide a stable base for the device 20 when in use. The configuration of the base section 24 can vary from the hoop as discussed in the above-referenced publication. The base section 24 is positioned generally beneath the seat support frame 26 in order to offset the load or moment applied to the post 28 and created by a child placed in the seat 22 of the cantilevered support arm 30. The base section can be foldable or collapsible or can be capable of being easily broken down for storing the device when not in use.

Other components of the frame assembly 21, such as the seat support frame 26, may also vary considerably in orientation, size, shape, configuration, and the like and yet fall within the spirit and scope of the present invention. In this example, the seat support frame 26 is a square or rectangular ring defining an opening (not shown) to accept the seat 22. The seat frame 26 may have releasable latches, locking mechanisms, surface contours, and the like for securely mounting the seat 22 to the frame 26 if desired. Alternatively, gravity alone can be relied upon to retain the seat in position. While other configurations and constructions of the seat support frame 26 are possible, the symmetrical shape of the disclosed seat support frame 26 permits the seat 22 to be mounted on the support arm 30 in a number of optional orientations. For example, the geometry and symmetry of the seat 22 and the support frame 26 be configured to allow the seat to be placed in the frame in multiple optional seat orientations. In FIG. 1, the seat 22 is oriented such that a right side of the seat is facing and closest to the post 28. In other examples, the seat may be re-oriented to a position with the back of the seat facing the post 28, with the front of the seat facing the post, or with the left side of the seat facing the post. Further information regarding the seat orientation options is set forth in the above-referenced publication. More generally, the disclosed device may be well suited for use with a variety of seats, seat orientations, and seat mounting configurations. For example, in some cases the seat frame 26 may be configured to accept and support a seat or other child carrying device from another product, such as a car seat.

Practice of the disclosed invention is not limited to the configuration of the exemplary frame assembly 21 described and shown in connection with FIGS. 1-3. In fact, other juvenile products can also employ and benefit from implementation of the disclosed invention. Notwithstanding the foregoing, one or more components of the frame assembly 21 of the disclosed device 20 may be well suited for implementation of a storage compartment as described below.

As noted above, the device 20 is shown and described herein merely by way of example to assist in describing and showing the systems, devices, features, and methods in accordance with the teachings of the present invention. In other examples, the disclosed invention and its various aspects and alternatives may be employed on other juvenile products with a seating area and a canopy or other similar object or surface. For example, the disclosed invention may be employed on a more conventional pendulum style swing, a stroller, a playard, an infant carrier, or the like within the spirit and scope of the present invention.

The disclosed orbit-like movement of the seat 22 of the device 20 creates a uniquely soothing motion for a child occupying the seat. In addition to soothing movement, the device 20 can be configured to incorporate a speaker 38 that can emit sounds generated from a source on-board the device. The sounds can be selected to enhance the soothing nature of the device, if desired. In one example, the device 20 can be configured with selectable sound options stored in an on-board memory of the device. A user can access and select one of the plurality of sound options by using the user interface 37 on the control portion 36. The selected sound option can then be emitted from the speaker 38. The user interface can also provide a volume control function to adjust the volume of the emitted sounds.

In accordance with the teachings of the present invention, a user can optionally select to connect a separate music player or other electronic audio unit, such as a handheld MP3 player or the like, to the device 20. When connected as discussed herein, the speaker 38 can emit sound generated via the separate electronic unit. To that end, the device 20 also incorporates a storage compartment 40 into the housing 29. The storage compartment 40 includes a tray or drawer 42 (see FIG. 2) that can slide into and out of an opening 44 out from within the housing 29 of the post 28. The tray 42 can be opened or closed as desired, and can be opened to expose a storage space on the tray. The tray can be configured to be manually opened or closed or to be automatically opened or closed upon pressing a button (not shown) near the storage compartment 40 or on the user interface 37, similar to a conventional compact disc (CD) or digital video disc (DVD) player.

In the disclosed example, the housing 29 of the post 28 has a contoured outer surface. In this example, a front surface 46 of the housing 29 faces in a direction opposite the support arm 26 and, thus, the seat 22. Also in this example, the control portion 36 of the housing 29 is a rounded, semicircular extension that overhangs the front surface 46 of the post housing 29. The storage compartment 40 is positioned on the front surface 46 of the housing 29 and the tray opens outward from the front surface in a direction opposite the seat 22. The top surface of the control portion 36 faces upward and is angles slightly in a direction away from the seat 22 as well. Thus the user interface is clearly visible and accessible to a caregiver standing on the front side of the post 28.

While the disclosed device employs a relatively intricate shape and contour for the housing 29, the housing shape need not be complex or the same as that shown. Other embodiments may alternatively include a post with four square sides, or a single cylindrical column, or the like. The post housing 29 can be manufactured from an injection molded plastic or thermoplastic material, can be formed of stamped and/or drawn sheet metal, or can be formed using other suitable materials and processes.

Advantageously, the contours, size, and shape of the housing 29 can be configured to provide versatility and to accommodate additional optional features and components. Specifically, the large surface area of the disclosed housing 29 allows the user interface 37 to be conveniently positioned to be easily accessible by the caregiver. Similarly, the interior volume of the housing 29 can be configured to provide a location for the storage compartment 40 and tray 42. As will be evident to those having ordinary skill in the art upon reading this disclosure, the storage compartment 40 can be located in alternate positions or locations on a juvenile product, depending on the product configuration and the needs for that product.

As illustrated in FIG. 2, the storage compartment 40 in this example is located sufficiently beneath the overhanging control portion 36 such that the overhang does not severely impede the caregiver from accessing the storage space of the tray 42. Additionally, the storage compartment 40 is centered on the front surface 46 of the housing 29 and thus is directly opposite the child seat 22.

Figure 4:
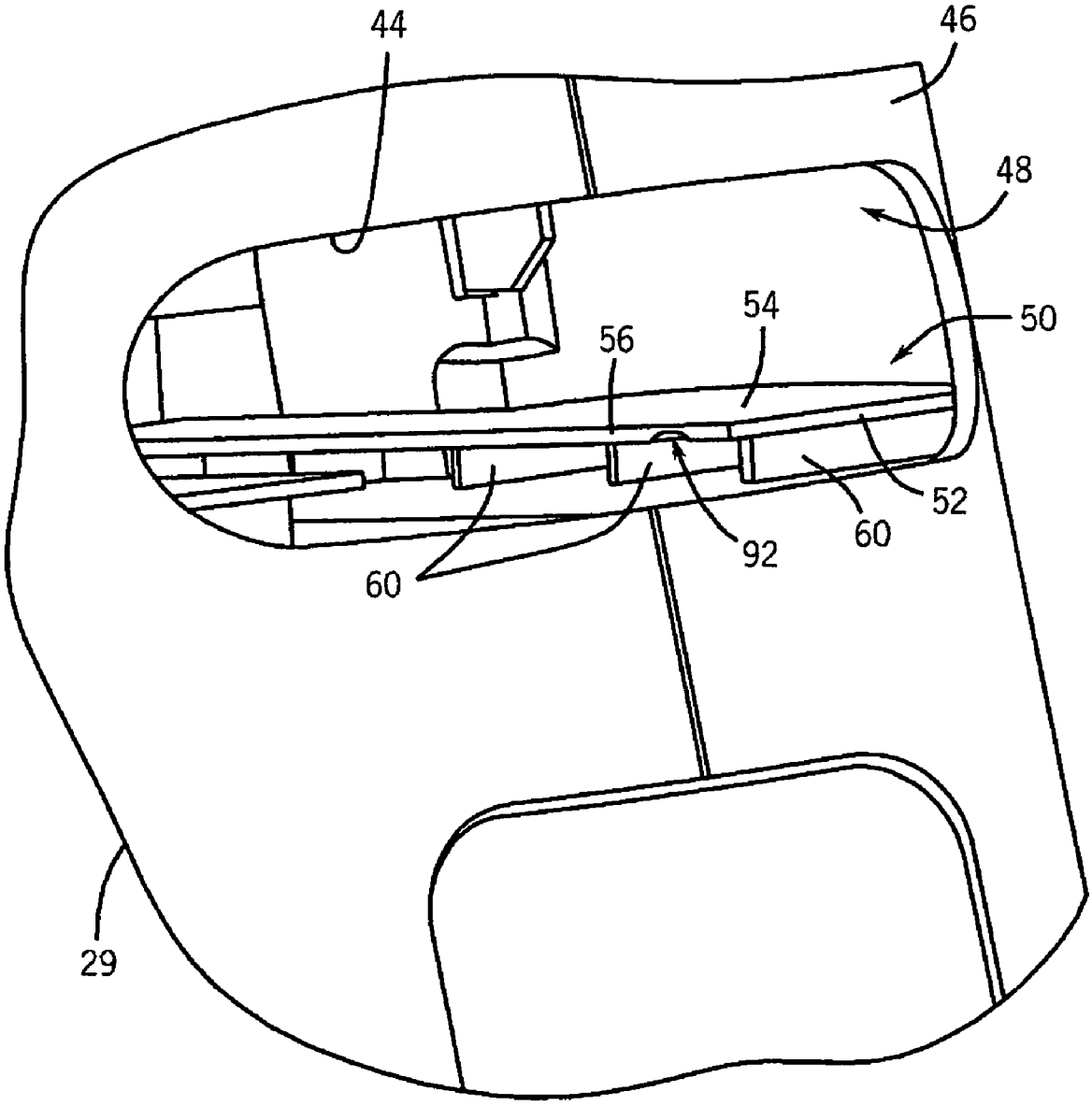
FIG. 4 is a side perspective view of a housing of the child motion device of FIG. 1 with a tray or drawer of the storage compartment removed.

With reference to FIG. 4, the storage compartment 40 also includes a tray receptacle 48 within the housing interior and behind the opening 44 in the front surface 46. The receptacle 48 is configured and sized to provide the space and functional underpinning for the tray 42. The receptacle 48 is situated completely in the interior of the housing 29 and is accessible through the opening 44 in the front surface 46. The receptacle 48 is sized such that it can accommodate the height, width, and depth of the tray 42, as well as any contents on the tray and the tray mounting components. The mounting components for the tray 42 include a pair of opposed tracks 50. The tracks are created on and project inward from opposite interior surface 51 of the housing 29 within the receptacle 48. In this example, each of the tracks is a mirror image of the other and, thus, only one of the tracks is described herein. The other track is essentially identical in this example.

The right side tray support or track 50 is visible in FIG. 4 through the opening 44. The track 50 has a planar plate or panel 52 projecting from the right side interior surface 51 of the housing. The plate 52 has a planar top surface 54 that is generally flat and facing upward. The plate 52 extends laterally across the receptacle part way toward the opposite plate, leaving a gap between exposed edges 56 of the plates. The plate 52 extends depth-wise into the receptacle so as to be capable of supporting the tray 42. In this example, a plurality of ribs 60 are positioned and spaced apart beneath an underside of the plate 52. The ribs 60 provide structural support for the plates 52 and extend out from the interior surface 51 of the housing. However, each rib terminates short of the exposed edge 56 of the plate 52. This leaves a free portion of the plate extending beyond the ribs. This portion of the plate creates a slide track or rail for the tray 42. As noted above, structure of the track 50 is mirrored on the left side of the receptacle 48. The two tracks 50 combine to support the tray 42 in this example.

Figure 5:
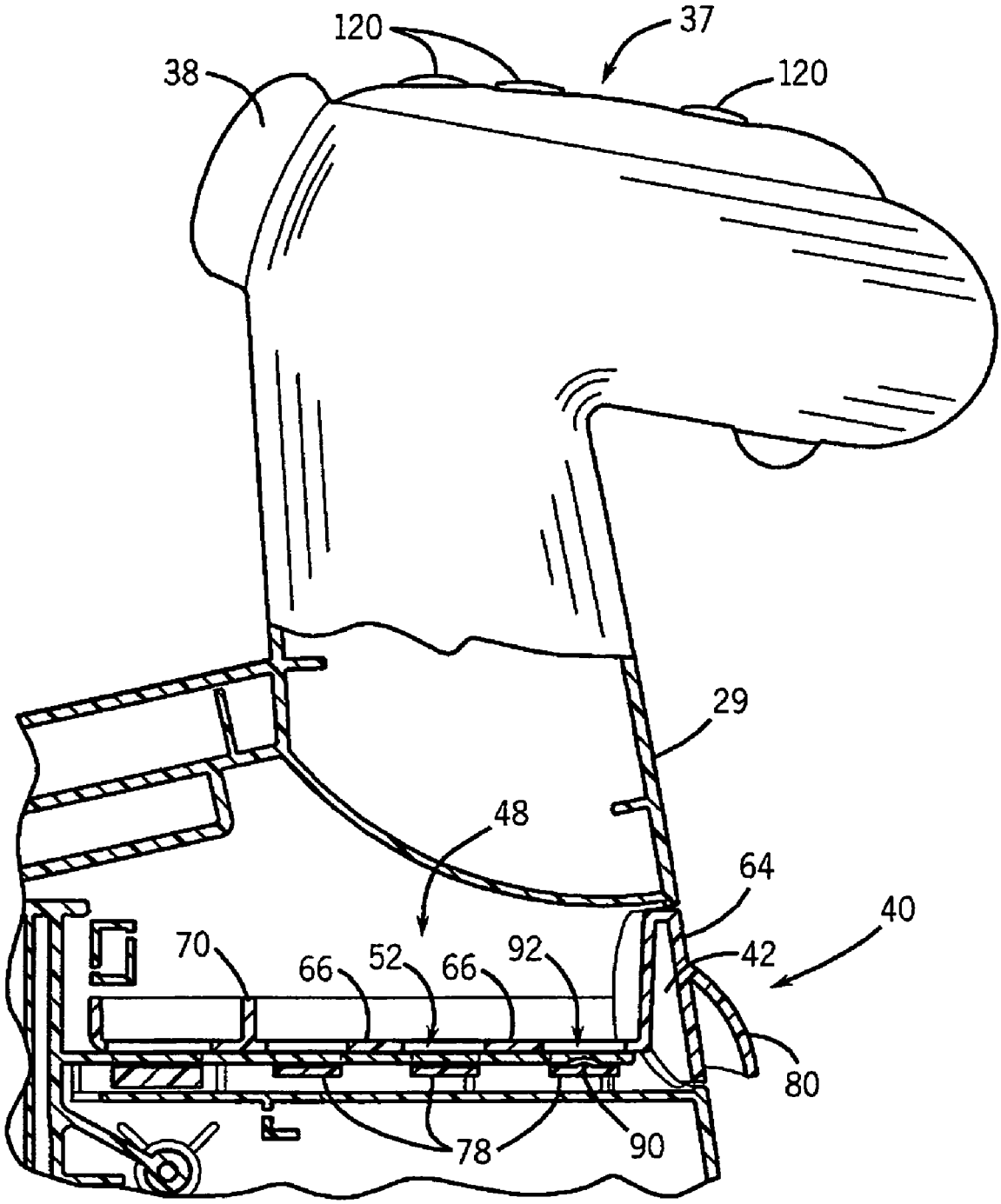
FIG. 5 is a vertical cross section of the child motion device housing taken along line V-V of the device shown in FIG. 3 with the tray or drawer of the storage compartment in the closed position.

Turning now to FIG. 5, the front of the tray 42 has a front face or panel 64 that is shaped to match and fit within the opening 44 into the receptacle 48 of the housing 29. The front panel 64 is also shaped having the same contour as the front surface 46 of the housing 29. Since the tray front panel 64 is sized to fit within the perimeter of the opening 44, the panel lies within the opening flush with the front surface 46 of the housing 29 when the tray 42 is in the closed position. FIGS. 3 and 4 show the tray 42 in the closed position and shows that the tray 42 fits entirely within the receptacle of the post housing 29 when closed. Thus, the front panel acts as a closure device for the storage compartment. In other examples, the closure can be a hinged door or lid that covers the storage compartment, for example.

The tray 42 in this example is generally rectangular in plan view and has a width roughly the lateral width of the tray front panel 64. The tray 42 has a rearward depth in a direction into the housing 29. The tray 42 also has a bottom wall 66 and shallow, rearward extending side walls 68 along side edges of the bottom surface. A rear wall 70 extends laterally across the rear of the tray between the side walls and is spaced rearward from the front panel 64. The tray height is defined by the side walls 68 and the rear wall 70, which in this example have a height less than that of the tray front panel 64. A storage area is created with the parameters of the side walls 68, the rear wall 70, and the front panel 64. The entire tray 42, other than the front panel 64 fits within the receptacle 48 in the interior of the post 28 and is sized and shaped so as not to interfere with other functional aspects of the device 20.

It should be noted that while the tray 42 in the disclosed example is sized and shaped to fit with this particular device 20, the tray in accordance with the invention is not limited to any particular configuration. Also, the tray need not lie precisely flush with any surrounding surfaces. Further, the tray may be mounted in a variety of ways and yet slide, pivot, or rotate between a closed and an opened position.

As best shown in FIGS. 5-8, the tracks or rails of the plates 52 are captured by parts of the tray during use. The tracks 50 are captured in outward facing channels 72 formed on each side of the tray. The channels 72 are created by a plurality of downward and outward extending fingers 74. A series of the fingers 74 are provided on each side of the tray bottom panel 66 spaced inward of the side walls 68. Each of the fingers has a vertical leg 76 depending from the bottom panel 66. Each of the fingers 74 also has a horizontal leg 78 extending from the vertical leg and spaced beneath the bottom panel, thus creating a gap between the bottom panel and each of the legs 78. Each leg 78 has an L-shape when viewed from the front or back (see FIG. 8). In this example, the horizontal legs 78 on each side of the tray project outward and away from the legs on the other side of the tray and toward the ribs 60 on the same side. A series of the legs 74 are aligned with one another along each side of the tray 42 to form the channels 72.

The vertical distance or gap above the legs 78 is slightly greater than the thickness of the exposed edges 56 on the plates 52. In addition, the spacing between the exposed edges 56 of the left and right plates 52 allows the fingers to fit laterally between the fingers 74. Thus, the left and right plate edges are horizontally captured between the vertical legs 76 of the fingers and vertically captured between the bottom panel 66 of the tray and the horizontal legs 78 of the fingers. Thus, the tray channel 72 can slide along the corresponding track 50 on each side of the tray.

FIGS. 2 and 3 show the tray 42 in an open position and a closed position, respectively. Movement of the tray 42 from the closed position within the receptacle of the housing 29 to an open position extending from the housing 29 is achieved by pulling or pushing the tray 42. A handle 80 or grip is formed on the front panel 64 of the tray 42 in this example. In this example, a protruding mid-section of the front panel 64 creates the handle 80. The handle is hollow from the underside in this example and thus permits a user to place their finger under and behind the handle to facilitate pulling the tray 42 out from the receptacle 48.

The tray 42 and its contents, when returned to the closed position of FIGS. 1 and 3, are protected by being completely enclosed within the storage compartment 40. Also advantageously, the tray 42 slides into the open position away from the infant occupant, thus minimizing the infant's reach-ability to access to the contents of the tray 42. In addition, an on-board wire connector 82 with a standard jack 84 is provided in this example (see FIG. 2). The wire connector 82 and jack 84 are coupled to the device's on-board speaker 38. Thus, a user can open the tray, connect the connector jack 84 to a headphone jack receptacle 86 on their personal music player 88 (see FIG. 2) or other electronic device, place the player into the tray, and close the tray. In the disclosed example, the entire player 88 and all wires 82 are hidden and protected within the storage compartment 40 when closed. Further, a user need not employ their own wire jumpers in order to connect the player to the device 20. Instead, the wire or wires 82 are provided within the storage compartment. Depending on the sophistication of the device 20, the selected player 88, and the sound system and speaker(s) 38, more than one wire 82 or several different optional selectable wires 82 can be provided to accommodate a variety of players.

Figure 6:
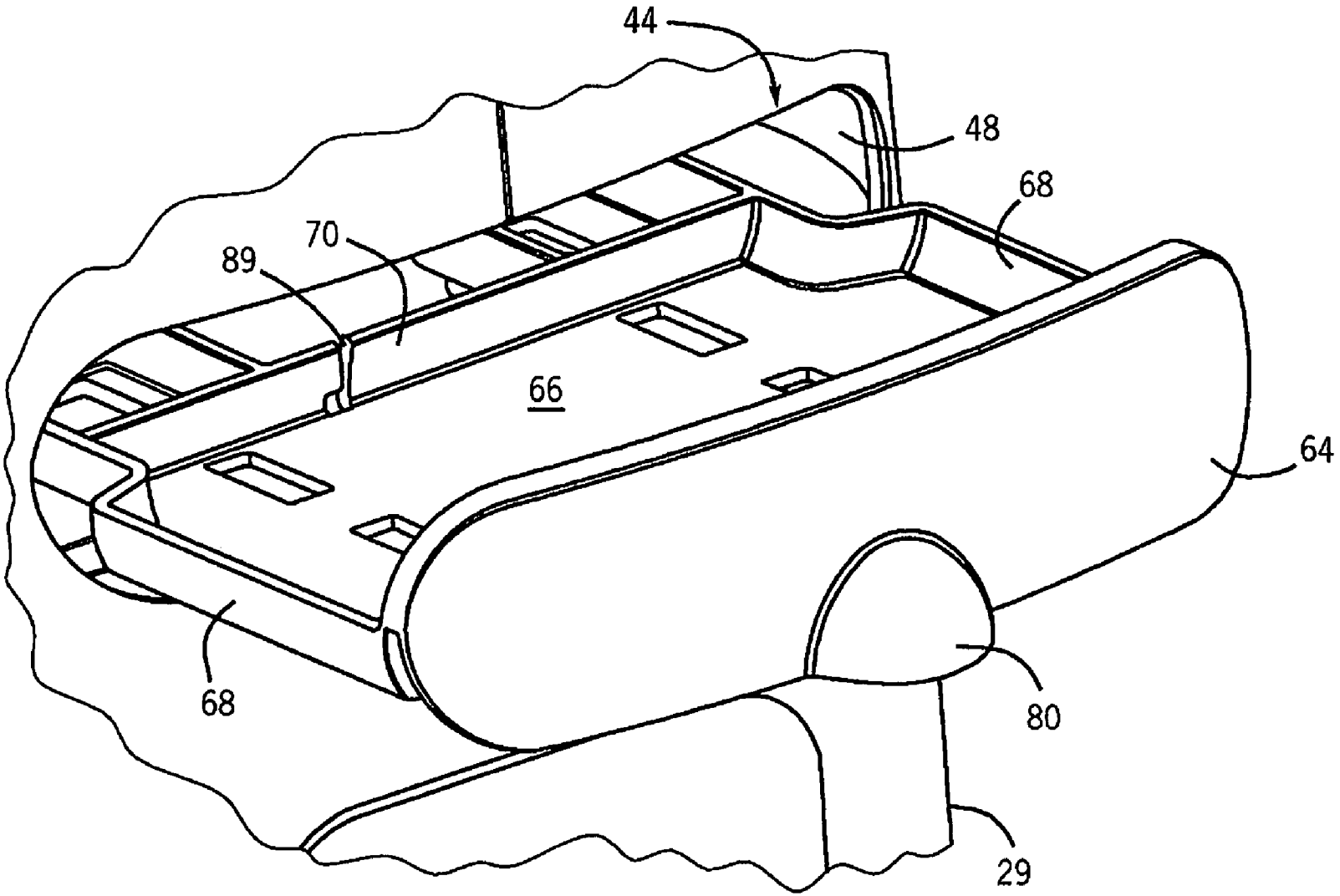
FIGS. 6 and 7 are top and opposite side perspective views of the tray or drawer in FIG. 2 in the opened position.
Figure 7:
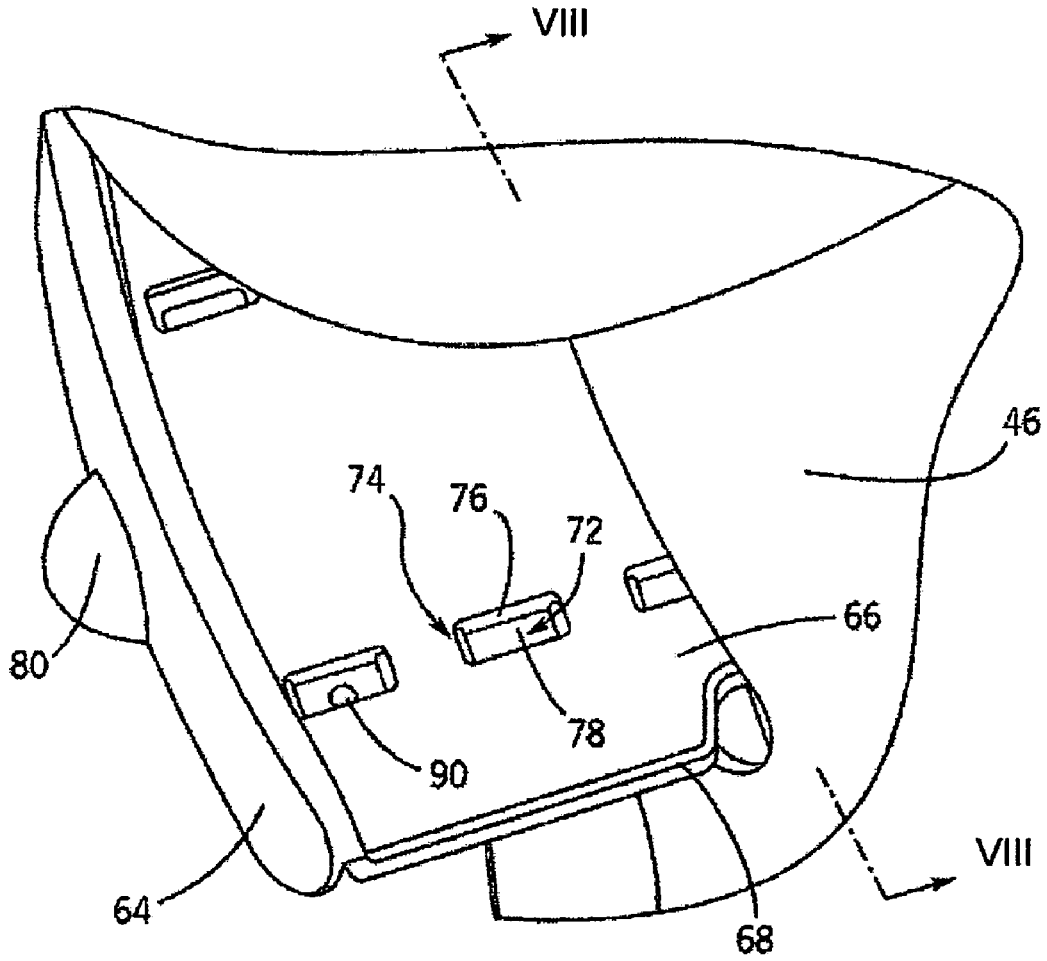

The audio cord or cords 82 can be coupled to the user interface 37 and to the speaker(s) 38. The cords or wires 82 can be routed within the housing 29, each terminating with the headphone jack 84 disposed in the storage area of the tray 42. As shown in FIG. 6, the audio cord 82 can be secured in place by providing a slot 89 in the back wall 70 of the tray. The slot 89 is an open notch that runs from the top of the wall 70 down to near the top side of the tray bottom panel 66. The slot 89 can be designed such that its width is greater at the bottom than it is at the top. The narrow portion of the slot 89 can thus be slightly narrower than the size of the cord 82. The cord can be forced down into the slot and then seat in the wider bottom portion. The entire slot width can be less than the size of the jack 84. This feature can assist in retaining the cord 89 from slipping out the back of the tray 42 as well as preventing the cord from being easily removed upward and out of the slot 89. Multiple slots 89 can be provided if multiple cords 82 are present in the device 20.

Figure 8:
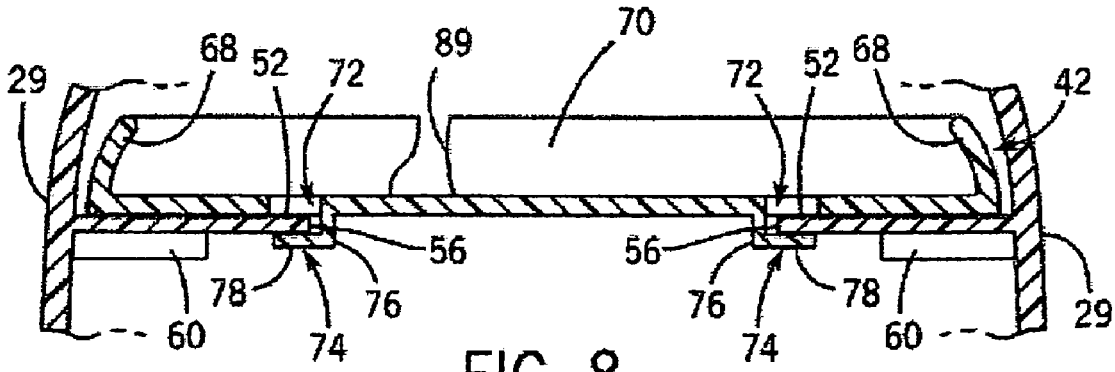
FIG. 8 is a lateral cross section of the opened drawer or tray taken along line VII-VIII in FIG. 7.

FIGS. 4, 5, and 8 show a drawer catch or detent mechanism that can assist in retaining the tray in a closed position. In this example, the detent mechanism includes a projection or nub 90 and a correspondingly shaped dimple or receiver 92 on each side of the tray 42. In this example, a semi-spherical nub 90 projects upward from a top surface of the horizontal leg 78 on the forward most one of the fingers 74 of each series of fingers. Each nub 90 is a convex bump that protrudes upward. Also in this example, each dimple or receiver 92 is a concave depression into the underside surface of the respective plate 52. The dimples 92 are sized and positioned to allow the nubs 90 to interferingly seat within the dimples when the tray 42 is in the closed position.

When the caregiver pulls on the tray handle 80, the caregiver must apply enough force to overcome the interference fit of the nubs 90 and dimples 92 in order to begin to slide the tray 42 to an open position. Upon closing the tray 42, the caregiver will receive positive feedback from the detent mechanisms to know when the tray is fully closed. As the tray slides rearward into the receptacle 48, the nubs will snap or pop into the respective dimples when seated, providing the positive indication. Ultimately, the force necessary to unseat the nubs 90 can be designed so as to resist an infant's attempts to open the tray 42, and yet readily permit an adult to open the tray. The detent mechanism or mechanisms can be configured to manage or reduce undesired access and opening of the tray.

Figure 9:
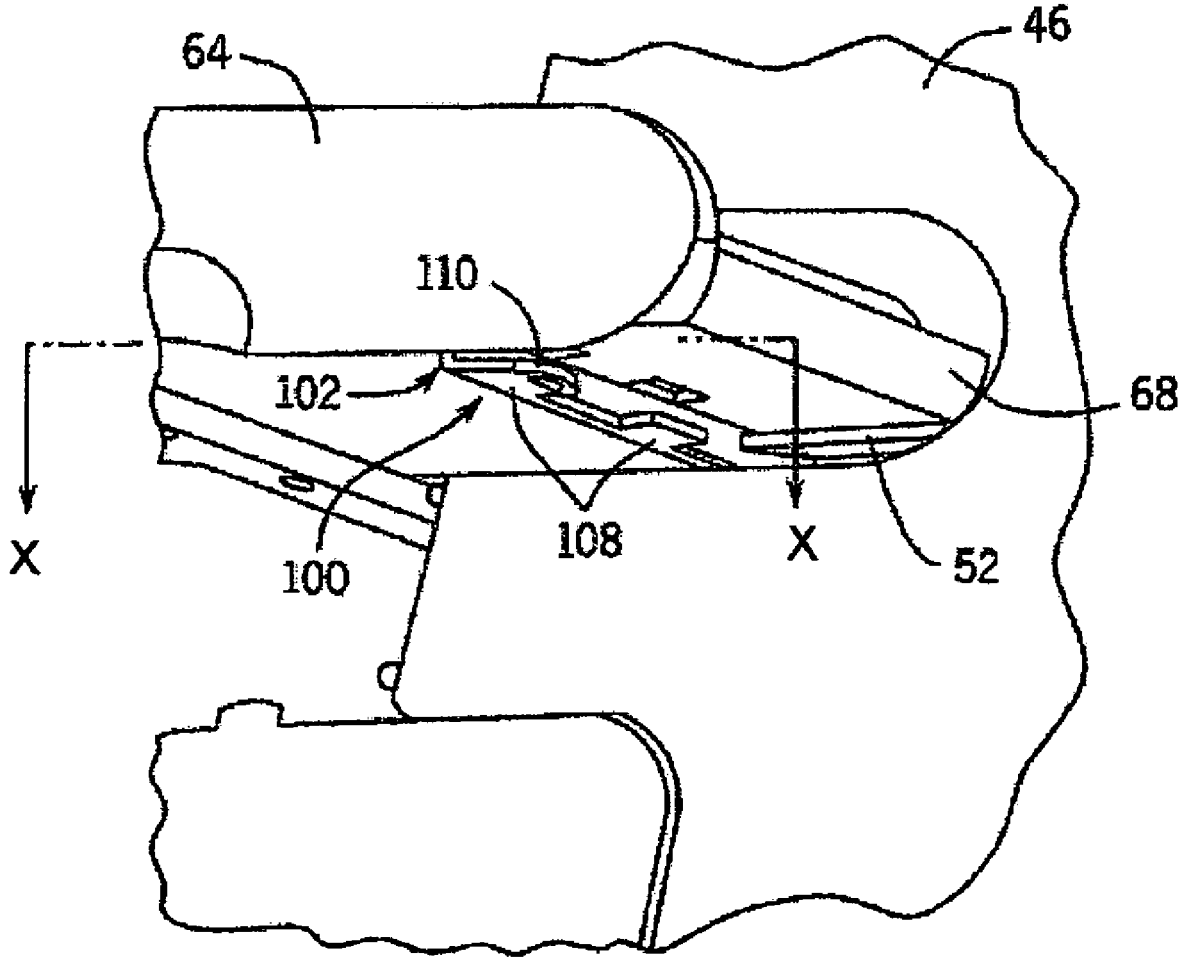
FIG. 9 is a bottom and side perspective view of another example of a storage compartment drawer or tray in an opened position.
Figure 10:
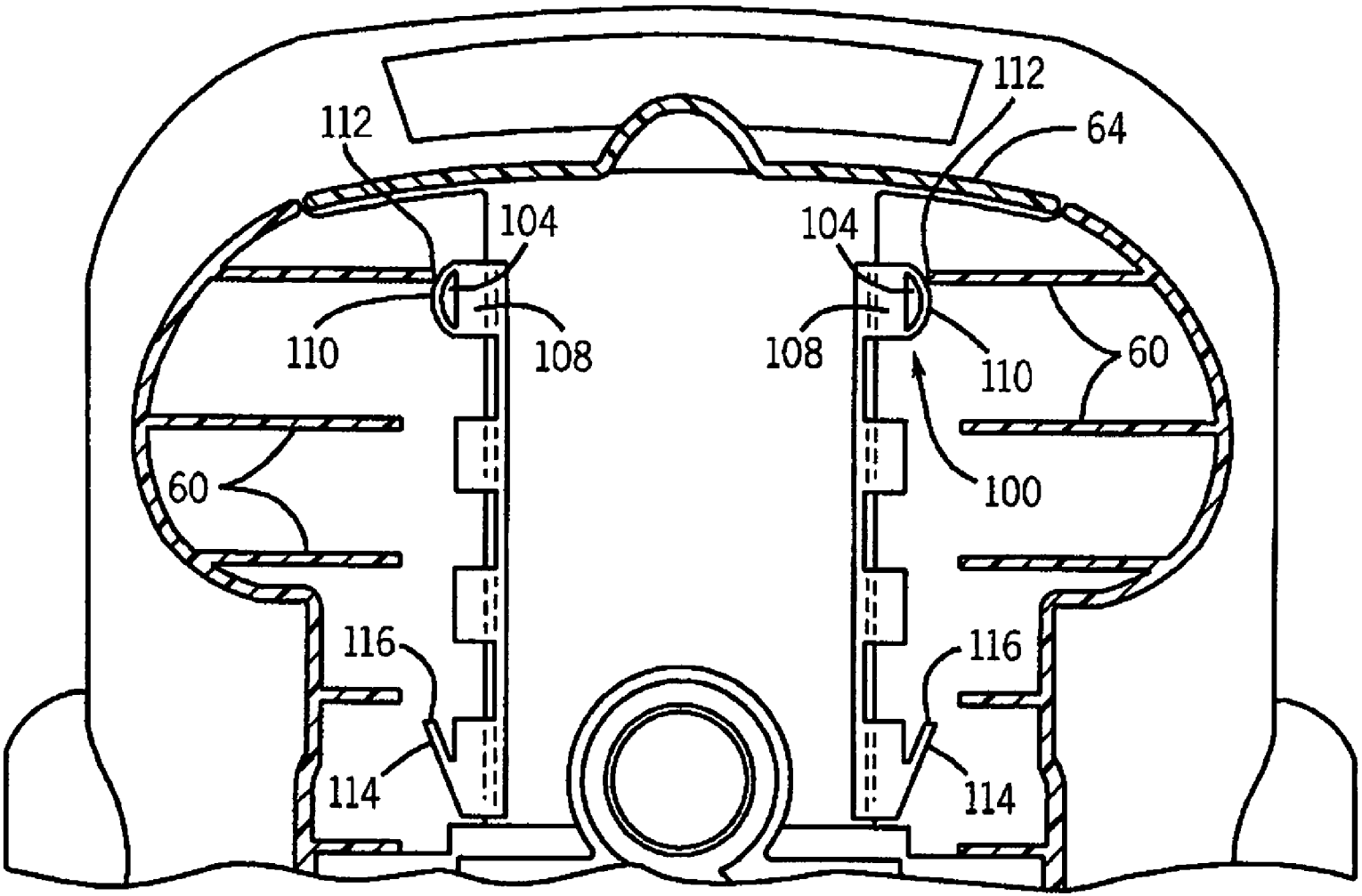
FIG. 10 is a horizontal cross section of the drawer or tray taken along line X-X of the opened storage compartment in FIG. 9.

An alternative embodiment to the catch or detent mechanism is shown in FIGS. 9 and 10. Here, a child resistant, resilient spring latch 100 is incorporated into the underside of the tray bottom surface 66. Similar to the aforementioned catch or detent mechanism example, the spring latch 100 utilizes 'L' shaped fingers 102 that capture the plates 52 of the tracks 50. The tray finger 102 nearest the tray front panel 64 is configured with an opening 104 on the end of its horizontal leg 108, which creates a resilient, flexible bridge 110 on the tip of the leg. The bridge 110 is rounded or curved and can flex inward upon application of pressure to the bridge. The bridge 110 on each side of the tray 42 interferingly contacts the exposed tip 112 of the respective forward most rib 60. In order to begin the movement of the tray 42 from the closed position, the caregiver must overcome the interference resistance between the rounded bridge 110 and rib tip 112. The horizontal leg 108 on this finger can extend further inward than on the other fingers as necessary to create the contact.

In either of these examples, the detent mechanism components can be designed to require a predetermined force or load in order to open the tray 42. The load can be selected so as to achieve a desired result, such as to inhibit a child from opening or easily opening the tray.

In addition to the above, the tray 42 in either example can include one or more travel stop mechanisms in order to prevent the caregiver from sliding the tray past a fully extended open position. FIG. 10 illustrates one such stop mechanism. In this example, the rearward most finger 102 relative to the front panel 64 is configured with a V-shaped or inwardly extending tab 114. The V-shape of the tab 114 opens toward the tray front panel 64. As the tray 42 is slid or pulled to the open position, the tips 116 of the tabs 114 contact the forward most rib 60 at the fully opened position. In this case, the forward most rib 60 can extend further inward toward the center of the receptacle 48 in order to assist in creating the contact. The tabs are resilient inward if loaded from the side. This allows the tabs 114 to travel past each set of ribs 60 during installation of the tray 42 into the receptacle. Once installed, the rib 60 length, and the angles and tips 116 of the tabs can pass each rib except the forward most rib 60. This last rib 60 will prevent the tabs from reversing direction past the rib. Thus, the tray 42 will be prevented from further outward travel.

In accordance with another aspect of the disclosure, the child motion device 20 disclosed herein can configured with audio soothing capability. It should be appreciated that while the storage compartment 40 may be useful for storing a wide variety of items, it has been configured in this example specifically for use with a handheld music player. With reference to FIGS. 2, 5, and 6, the user interface 37 is disposed on top of the housing control portion 36. In this example, the user interface 37 occupies nearly the entire top surface of the control portion 36. The user interface 37 can provide a number of user controls 120 directed at operation of the device 20 and its various features. In one example, the user interface 37 can include a set of music playback controls, such as volume up/down, forward/rewind, track forward/rewind, and the like. The device 20, as noted above, can include an on-board memory or music and/or sound source. The user interface 37 also can be configured as an electronic hub for controlling the external audio source 88 that is connected to the cord 82 and housed in the storage compartment 40, including controlling the audio output at the speaker 38.

Generally speaking, the foregoing aspects of the disclosure allow the caregiver to play music from their own music source for children while minimizing child access to the music device. Maintaining a safe distance between the music player 88 (and any cords 82) and the child occupant helps avoid problems that might otherwise arise while the tray 42 is open. Completely hiding both the player and cords within the storage compartment 40 only enhances this beneficial advantage. Other embodiments may include one or more additional cables or cords to support additional functionality, such as a recharging/power supply and more complex user interface controls. Other more sophisticated features may also be employed. In one example, music playback could only be commenced if a sensor on a tray communicates that a tray is in the closed position. Also, should an external power supply be required to drive a complex user interface or provide power to an audio player recharging device, the child motion device may employ connectivity to a wall socket. Regardless of additional features, the disclosed examples can also provide relatively safe integration of a portable music player. The resistive force of the disclosed detent mechanisms may minimize a child's ability to override the mechanism and open the tray 42. Further, by completely enclosing the integrated music device cord 82, a child is at least inhibited from accessing the cord 82.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding only, and no unnecessary limitations should be understood therefrom, as modifications within the scope of the invention may be apparent to those having ordinary skill in the art.

Although certain child motion devices, systems, and methods have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child motion device comprising:

a frame assembly;

a seat supported by the frame assembly for movement with a child occupying the seat;

a housing on the frame assembly;

a receptacle in the housing; and a storage drawer defining a storage space, the drawer being movable between an opened position in which the storage space and the drawer extend outside the housing and a closed position in which the drawer fits within the housing and closes the storage space, wherein the drawer is configured to slide along a track within the receptacle, and wherein the drawer includes a set of L-shaped fingers aligned front to back along a bottom surface of the drawer and the track includes an exposed edge captured between a leg of the fingers and the bottom surface of the drawer.

2. The child motion device of claim 1, wherein the drawer includes a detent mechanism that resists movement of the drawer from the closed position.

3. The child motion device of claim 2, wherein the detent mechanism further comprises a nub located on the bottom of the drawer.

4. The child motion device of claim 1, wherein the drawer includes a front panel that lies flush with a surface of the housing when the drawer is in the closed position.

5. The child motion device of claim 4, wherein the drawer has a handle located on the front panel of the drawer.

6. The child motion device of claim 1, further comprising a pair of the set of fingers and a pair of the tracks, one of each near each side of the drawer.

7. The child motion device of claim 1, further comprising a detent mechanism having a nub on one of the legs or on the bottom surface and a dimple on the other of one of the legs and the bottom surface.

8. The child motion device of claim 7, wherein the nub is on a top facing surface of a horizontal leg of one of the fingers, and wherein the dimple is on the bottom surface of the drawer.

9. The child motion device of claim 1, further comprising a detent mechanism having a resilient element on a tip of one of the legs and a fixed element on a part of the housing.

10. The child motion device of claim 1, further comprising a speaker on a part of the frame assembly and an audio cord with a connector jack exposed within the receptacle and lying in the storage space of the drawer, the cord being configured to connect an external electronic device to the speaker.

11. The child motion device according to claim 10, further comprising a user interface on a part of the child motion device configured to control operation of the external electronic device when coupled to the connector jack.

12. A child motion device comprising:

a frame assembly;

a seat supported by the frame assembly for movement with a child occupying the seat;

a housing on the frame assembly;

a receptacle in the housing; and a storage drawer defining a storage space, the drawer being movable between an opened position with the storage space and the drawer extending outside the housing and a closed position with the drawer and storage space within the receptacle in the housing;

a speaker on a part of the frame assembly; and an audio cord with a connector jack exposed within the receptacle and lying in the storage space of the drawer, the cord being configured to connect an external electronic device to the speaker, wherein the drawer is configured with a slot and the cord is retained in the slot such that the cord and connector jack move with the drawer to the opened position.

13. A child motion device comprising:

a frame assembly having a generally vertical post;

a housing covering the generally vertical post;

a cantilevered support arm extending radially outward from the post;

a seat supported by the support arm and capable of movement with a child occupying the seat through a partial orbital path around the post; and a storage compartment movable relative to the housing between an opened accessible position and a closed position within the housing.

14. The child motion device of claim 13, further comprising a speaker on a part of the post and an audio cord with a connector jack exposed within the storage compartment and lying in the storage space, the cord configured to connect an external electronic device with the speaker.

15. The child motion device of claim 14, wherein the storage compartment further comprises a tray slidable between an open position and a closed position, a rear wall on the tray, and a slot in the rear wall, wherein the cord is retained in the slot such that the cord and connector jack move with the tray to the opened position.

16. A child motion device comprising:

a frame assembly;

a seat supported by the frame assembly and capable of movement with a child occupying the seat;

a housing on a part of the frame assembly;

a storage compartment in the housing comprising a tray defining a storage space, the tray being slidable between an opened accessible position and a closed position, the storage space being sized and configured to hold an external music player with the tray in the closed position;

a speaker on a part of the child motion device;

an audio cord with a connector jack exposed within the storage compartment, the cord configured to connect the external music player with the speaker; and a detent mechanism configured to retain the storage compartment in the closed position until a predetermined load is applied to reconfigure the storage compartment to the open position, wherein the tray includes a front panel that closes the storage compartment when the tray is in the closed position.

17. The child motion device of claim 16, wherein the housing includes an opening to receive the tray and wherein the front panel lies within the opening in the closed position.

18. The child motion device of claim 16, wherein the tray is slidable in a direction away from the child when moving to the opened accessible position from the closed position.

19. A child motion device comprising:

a frame assembly;

a seat supported by the frame assembly for movement with a child occupying the seat;

a housing on the frame assembly;

a receptacle in the housing; and a storage drawer defining a storage space, the drawer being movable between an opened position in which the storage space and the drawer extend outside the housing and a closed position in which the drawer fits within the housing and closes the storage space;

a speaker on a part of the frame assembly and an audio cord with a connector jack exposed within the receptacle and lying in the storage space of the drawer, the cord being configured to connect an external electronic device to the speaker; and a user interface on a part of the child motion device configured to control operation of the external electronic device when coupled to the connector jack.

* * * * *